US012092355B1

(12) United States Patent
Davis

(10) Patent No.: US 12,092,355 B1
(45) Date of Patent: Sep. 17, 2024

(54) HIGH AND LOW TEMPERATURE SHUTDOWN PNEUMATIC THERMOSTAT AND METHOD

(71) Applicant: Ty Freeman Davis, La Plata, NM (US)

(72) Inventor: Ty Freeman Davis, La Plata, NM (US)

(73) Assignee: Eco Innovations, LLC, La Plata, NM (US)

( * ) Notice: Subject to any disclaimer, the term of this patent is extended or adjusted under 35 U.S.C. 154(b) by 0 days.

(21) Appl. No.: 17/816,282

(22) Filed: Jul. 29, 2022

Related U.S. Application Data

(60) Provisional application No. 63/294,650, filed on Dec. 29, 2021, provisional application No. 63/227,190, filed on Jul. 29, 2021.

(51) Int. Cl.
*F24F 11/76* (2018.01)

(52) U.S. Cl.
CPC ..... *F24F 11/76* (2018.01)

(58) Field of Classification Search
CPC ..... F24F 11/76; G05D 23/2754; G05D 23/27541; G05D 23/024; G05D 23/025; G05D 23/027; G05D 23/08
See application file for complete search history.

(56) References Cited

U.S. PATENT DOCUMENTS

| | | | | |
|---|---|---|---|---|
| 10,215,501 | B1 * | 2/2019 | Reist | F28D 21/0014 |
| 2004/0079809 | A1 * | 4/2004 | Oglesby | F16K 31/002 236/100 |
| 2004/0244500 | A1 * | 12/2004 | Kuroiwa | G05D 7/0146 73/861.52 |
| 2011/0011942 | A1 * | 1/2011 | Todaka | F16K 11/044 236/12.11 |
| 2016/0333767 | A1 * | 11/2016 | Pottie | F01P 7/165 |
| 2017/0074155 | A1 * | 3/2017 | Shimomura | F01P 7/165 |
| 2018/0135771 | A1 * | 5/2018 | Baer | G05D 23/08 |
| 2022/0120521 | A1 * | 4/2022 | Quix | F16K 31/002 |

* cited by examiner

*Primary Examiner* — Nelson J Nieves
*Assistant Examiner* — Matthew John Moscola

(57) ABSTRACT

A pneumatic thermostat and method, particularly suitable for oil and gas burner systems, which incorporates a dual seat valve with valve seats on each end, and a pair appropriately sized plugs, attached via a rod which is placed through the dual seat valve. This assembly is preferably coupled to a thermal expansion sleeve and internal rod, which move the assembly back and forth. With these mechanics and peripheral features, which can include for example high and low temperature venting and a bypass system, embodiments of the present invention can maintain a target temperature and shut-down pressure in the event that a temperature drops below an operating range.

17 Claims, 10 Drawing Sheets

HIGH AND LOW TEMPERATURE SHUTDOWN PNEUMATIC THERMOSTAT AND METHOD

CROSS-REFERENCE TO RELATED APPLICATIONS

This application claims priority to and the benefit of U.S. Provisional Patent Application No. 63/294,650, entitled "High and Low Temperature Shutdown Pneumatic Thermostat", filed Dec. 29, 2021, and this application claims the priority benefit of U.S. Provisional Patent Application No. 63/227,190, entitled "High and Low Temperature Shutdown Pneumatic Thermostat", filed Jul. 29, 2021, and the specifications thereof are incorporated herein by reference.

BACKGROUND OF THE INVENTION

Embodiments of the present invention relate to the field of oil and gas process equipment burner systems, more particularly to methods and apparatuses for reducing unignited methane emissions from such burner systems.

Traditional burner control of oil and gas process equipment, including but not limited to heater treaters, separators, tank heaters, dehydrators, in-line heaters and other process equipment, is defined here as a burner system with pneumatic thermostatic temperature control, known in the art as T12 thermostats. It is most common for oil and gas processing equipment to utilize natural gas (primarily composed of methane) as the pneumatic supply gas and as the fuel gas supply consumed by the main burner and standing pilot flame. These pneumatic thermostats use a thermal expansion rod in direct contact with vessel-contained fluid. When the contained fluid cools to a point lower than the pneumatic thermostat setpoint, the thermal expansion rod cools proportionally and contracts, opening a valve to supply control gas pressure to a pressure-open valve. This pressure-open valve is responsible for the fuel gas supply to a main burner, which is ignited by a standing pilot flame. Once fuel gas is sent to the main burner, the heat transfer rate is increased, the fluid temperature rises, the thermal expansion rod expands, and control gas pressure to the pressure-open valve is terminated. This process is continued indefinitely in maintaining vessel temperature.

The process and equipment discussed above, if performing properly, is effective in maintaining vessel temperature. This reliability, coupled with the simplicity of operation and simplicity of maintenance of traditional burner control, has driven mass deployment in today's oil and gas fields. Additionally, electronic burner management systems and auto-igniters are a relatively recent invention and with active process equipment dating as far back as the 1950's or further, traditional burner control makes up the majority of burner control systems in today's oil and gas fields.

The shortcoming of traditional burner control is the system's complete inability to recognize or solve the extinguishment of the standing pilot. Extinguishment of the standing pilot can be caused by numerous conditions. Examples include: liquid can condense in the pilot fuel gas line causing a momentary obstruction in the pilot orifice while exiting the orifice; the condensed fluid can also freeze when ambient temperatures are low enough causing the halt of pilot fuel gas flow; solid particulates can plug the small pilot orifice; strong gusts of wind can blow the pilot flame out; or other scenarios not mentioned. Once the pilot flame is extinguished, the system cannot recognize such, and when vessel temperature cools to a point that fuel gas is supplied to the main burner, unignited fuel gas is vented from the main burner uncontrollably until manual intervention is applied to relite the standing pilot flame. With the remoteness of some locations, manual intervention can be delayed by periods of days. With the large size of process equipment burners, substantial volumes of fuel gas (primarily methane) can be emitted to the atmosphere increasing the world's greenhouse gas concern. This shortcoming not only creates a serious emission issue, but the fact that substantial amounts of fuel gas are essentially lost forever means that a considerable loss of revenue can be experienced during the lifetime of a producing oil or gas well.

There are currently marketed burner management control systems and auto-igniters that can address this emission issue, and re-light the pilot or act as the ignition source for the main burner. Inherent issues lie within these products that cause resistance in wide deployment into a vast market with legitimate needs. One such issue is the added complexity these systems add to the burner system. As described above, traditional burner control is mechanical and simple. Additionally, technicians have more experience with traditional burner control and pneumatic gas systems in general. The addition of igniters, flame sensors, electrical harnesses and other required components, increase complexity during maintenance. Furthermore, marketed burner management systems and auto-igniters have the issue of introducing the dependency of the process equipment for vessel temperature. For example, if the battery bank has run down or an electrical component has failed, the equipment has no capability of re-introducing heat into the vessel. The remoteness of locations and the inexperience of technicians with electrical automation cause real issues, especially during winter months. Another, and perhaps the larger source of resistance to widely addressing the market issue, is the cost of these complex units in both cost of goods sold and in the amount installation labor. Well economics on many low producing wells does not allow for the purchase of these products. This issue is especially apparent in older, existing locations. Original Equipment Manufacture ("OEM") installation of burner management systems and auto-igniters is much more economical compared to retrofitting existing locations that can be remote and are most likely equipped with traditional burner control.

Accordingly, there is a need for methods and apparatuses for supervision and control of the burner system that are sufficiently simple, reliable and cost-effective for oil and gas process equipment.

BRIEF SUMMARY OF EMBODIMENTS OF THE PRESENT INVENTION

Embodiments of the present invention provide apparatuses and methods for thermostatic control of oil and gas burner systems. Further, embodiments of the present invention provide methods and apparatuses for the implementation of not only the traditional shutdown of the main burner once vessel temperature is at or above the set temperature but in addition, the shutdown of the main burner if vessel temperature falls below a specified operating range.

Embodiments of the present invention relate to a pneumatic thermostat that includes a valve assembly, which itself includes a dual seat valve, a first valve seat disposed or formed onto on a first end of the dual seat valve, a second valve seat disposed or formed onto a second end of the dual seat valve, a passageway connecting the first valve seat and the second valve seat, a connecting member disposed within the passageway, the connecting member rigidly connecting a first plug to a second plug and configured to translate within the passageway, and the first plug configured to seat against the first valve seat and the second plug configured to seat against the second valve seat. The pneumatic thermostat can also include a bypass stem configured to allow a flow of fluid through the thermostat to an end device during a bypass operation. Optionally, the bypass stem can be configured to autonomously reset when a bypass pressure is reduced. A bypass supply port can also be provided. The bypass supply port can have an internal cross-sectional area which is smaller than a sum total of all cross-sectional areas of exhaust paths when a bypass stem is in a reset configuration.

The pneumatic thermostat can also include a thermal expansion sleeve mated to an internal rod and the internal rod communicably coupled to the dual seat valve. The pneumatic thermostat can also include a dial stem communicably coupled to a third valve seat 55, and the first plug can be configured to also seat against the third valve seat 55. A sleeve can be coupled to a dial stem and the third valve seat 55 can be disposed or otherwise formed onto a terminal end of the dial stem. A body can be provided which encompasses the valve assembly and at least a portion of a bypass stem and the body can include a plurality of ports. Optionally, the first plug and the second plug can be at least substantially equal in size. The first valve seat and the second valve seat can have a conical shape. The connecting member can be a rod. Optionally, the first plug and the second plug can each have a curved shape, which can include a spherical shape (except for a connection location of the connecting member). The pneumatic thermostat can be configured to provide a valve open condition when subjected to an operating temperature, a valve closed configuration when subjected to a temperature that is greater than the operating temperature, and a valve closed configuration when subjected to a temperature that is less than the operating temperature.

Embodiments of the present invention also relate to a method for controlling a flow of hydrocarbon gas to a burner including shuttling a pneumatic thermostat valve between three states via a force generated from thermal expansion and/or contraction of a member, wherein the three states include a first state, the first state being a closed-valve state experienced when the member is in an expanded member condition, a third state, the third state being a closed-valve state experienced when the member is in a retracted member condition, and a second state, the second state being an open-valve state experienced when the member is in a condition between the expanded member condition and the retracted member condition and wherein hydrocarbon gas is allowed to flow from the pneumatic thermostat valve during the open-valve state. The expanded condition can be adjustable by manipulating a user input. The method can also include bypassing the pneumatic thermostat valve by manipulating a user input.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings:

FIG. 5 is a drawing which illustrates a traditional burner control for oil and gas process equipment, which embodiments of the present invention can integrate with;

DETAILED DESCRIPTION OF THE INVENTION

Figure 1:
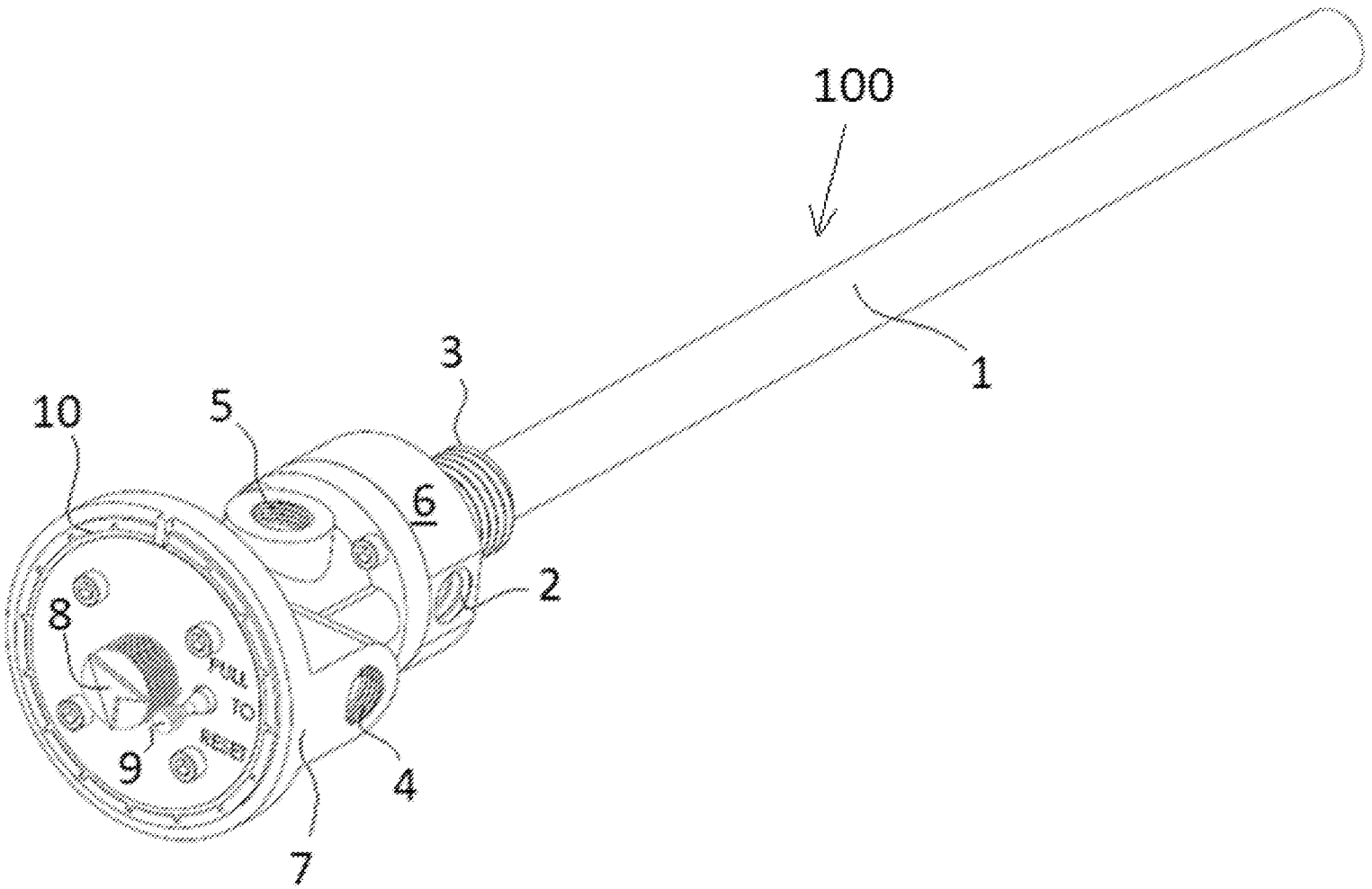
FIG. 1 is a drawing which illustrates a perspective view of a pneumatic thermostat according to an embodiment of the present invention.

FIG. 1 illustrates an embodiment of pneumatic thermostat 100, which most preferably comprises a formfactor that is at least substantially similar to that of a conventional pneumatic thermostat such that pneumatic thermostat 100 can be used in place of a conventional pneumatic thermostat. To be clear, thermostat 100 can operate in any desired orientation and thus references to "upper" and "lower", throughout this application, are made in reference to the orientation illustrated in the figures. In addition, the terms "high" and "target", when used in reference to temperature, can be used interchangeably throughout this application.

Figure 5:
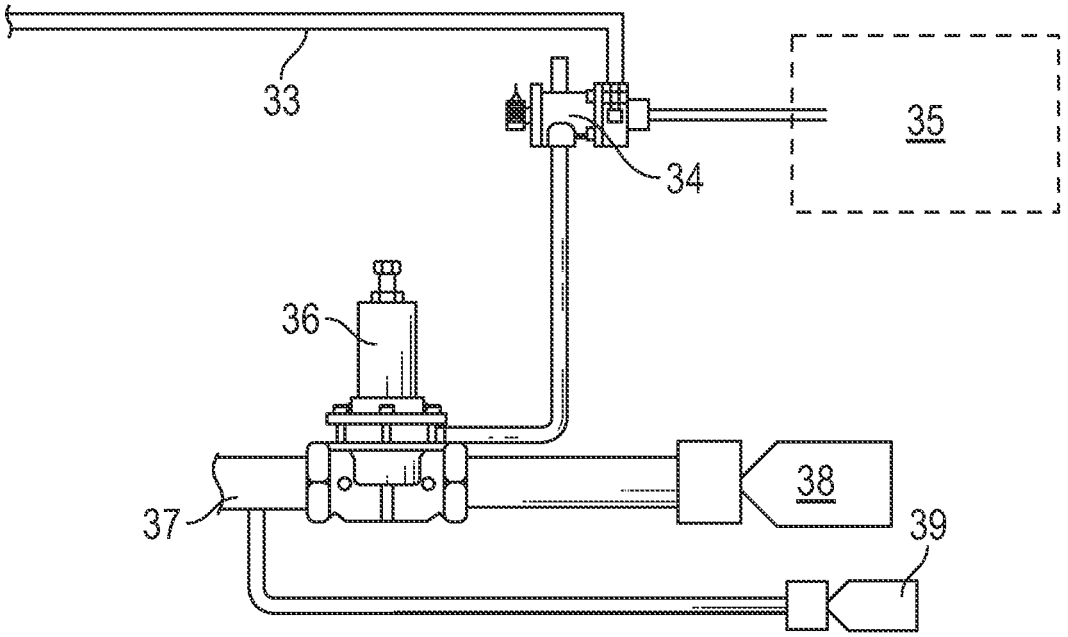
FIG. 5 (Prior Art)

In one embodiment of pneumatic thermostat 100, dial stem 8 is preferably used to set the target temperature of the burner control system. The target temperature can be represented by insignia on dial face 10, for example as is conventionally seen as a ring with protruding or recessed marks. Fastening fixture 3 can be used for installation of the pneumatic thermostat 100 into vessel fluid immersed thermowells. In one embodiment, fastening fixture 3 preferably comprises ½ inch nominal pipe thread. Expansion sleeve 1, preferably contains a dissimilar alloy rod as the primary mechanism for temperature detection and control. Base 6 preferably comprises a corrosion-resistant body with pressure input port 2. Body 7 preferably comprises a frame, which is most preferably formed from an alloy, which encompasses other components of the apparatus. Referring now to FIGS. 1 and 5, body 7 also preferably comprises a pressure output port 5, which can optionally be plumbed into a larger volume pressure open valve 36 that supplies main burner 38. Body 7 also preferably comprises exhaust port 4, which provides a relief port for any pressure trapped inside body 7, and which is preferably coupled via tubing to pressure open valve 36. Body 7 and base 6 can be fastened together by any method or apparatus known in the art, but most preferably by fasteners passing through body 7 and threading into base 6. Additionally, the interface between body 7 and base 6 can be sealed via a gasket.

Unlike the shortcomings of conventional oil and gas T12 thermostats, (namely their lack of low temperature shutdown), embodiments of pneumatic thermostat 100 provide capability of low temperature shutdown in fault conditions. More particularly, pneumatic thermostat 100 preferably incorporates an operating temperature range to not only allow for target temperature achievement and maintenance, but also a burner system shutdown for low temperature conditions that can only exist during improper performance of a burner system. This added capability introduces the possibility for a system reset to occur if a low temperature fault is detected.

As illustrated in FIG. 1, bypass plunger 9 is preferably provided and allows for a reset function. By actuating bypass plunger 9, the user can allow actuation pressure through thermostat 100, thus allowing main burner 38 to come on after remedying the existing fault. This, in turn, allows the vessel temperature to increase back into the operating temperature, which, in turn, trips bypass stem 9 back to the normal position allowing thermostat 100 to return to normal operation.

Figure 2:
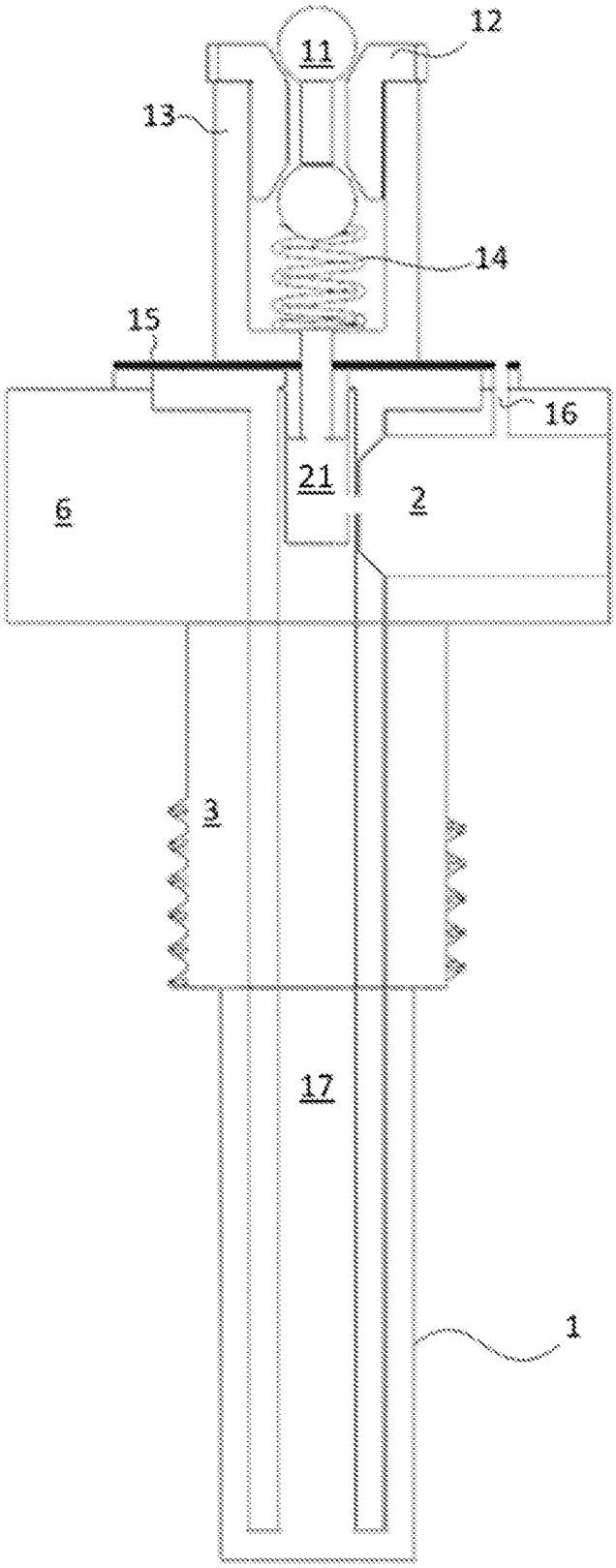
FIG. 2 is a cross-section view drawing which illustrates an internal dual seat valve according to an embodiment of the present invention.

FIG. 2 illustrates a lower portion of thermostat 100, which internal valve and components allow thermostat 100 to perform within an operating temperature range. Passage of gas pressure is allowed from pressure input port 2 through valve shuttle port 21 to the inside of valve shuttle 13. The allowance of gas pressure between peanut valve 11 and dual seat valve 12 directly actuates the fuel gas flow to the main burner 38 (see FIG. 5). As illustrated in FIG. 2, valve shuttle 13 is preferably communicably coupled to valve shuttle rod 17 and valve shuttle rod 17 is preferably communicably coupled to expansion sleeve 1. Valve shuttle rod 17 is preferably made of an alloy with a much lower thermal expansion coefficient than that of expansion sleeve 1. Because shuttle rod 17 is preferably coupled to expansion sleeve 1, as expansion sleeve 1 expands in length, as the vessel contained fluid that it is immersed in increases in temperature, shuttle rod 17 is thus pulled in a direction toward the lower end portion of expansion sleeve 1, thus causing valve shuttle rod 17 to pull valve shuttle 13 to a point that the lower ball of peanut valve 11, being held up by valve spring 14, contacts the lower conical face of dual seat valve 12. This contact makes a seal and ceases fuel gas allowance. Inversely, as the vessel contained fluid cools, expansion sleeve 1 contracts moving dual seat valve 12 off of contact with the lower ball of peanut valve 11, thus allowing fuel gas passage and returning fuel gas to main burner 38. With the return of increased thermal transmission in the burner control system, the vessel fluid temperature can increase and once again return the lower seat of dual seat valve 12 to contact with the lower ball of peanut valve 11 at the point of set target temperature, thus ceasing the main burner 38. At the point that increased thermal transmission is not achieved due to improper ignition of main burner 38, the novelty of the upper seat of dual seat valve 12 is demonstrated. If vessel temperature continues to cool to a differential between target and actual that is only possible due to improper main burner performance, valve shuttle rod 17 preferably pushes dual seat valve 12 to a point that the upper conical valve seat contacts the upper ball of peanut valve 11, thus ceasing the flow of fuel gas to main burner 38.

The function of venting trapped pressure to effectively close pressure open valve 36 is also preferably provided by thermostat 100 as described below. Although in one embodiment, a ball-shaped structure is preferably used for upper and lower balls of peanut valve 11, the balls need not be spherical to provide desirable results, so long as a top of the top ball can adequately seal against a bottom of stem port 19, a bottom of the top ball can adequately seal against a top of dual seat valve 12 and so long as a top portion of the lower ball can adequately seal against a bottom portion of dual seat valve 12. Thus, the upper and lower balls are also referred to respectively herein as a "plug" and it is to be understood that the exact shape and configuration of the plugs is not essential.

Figure 3:
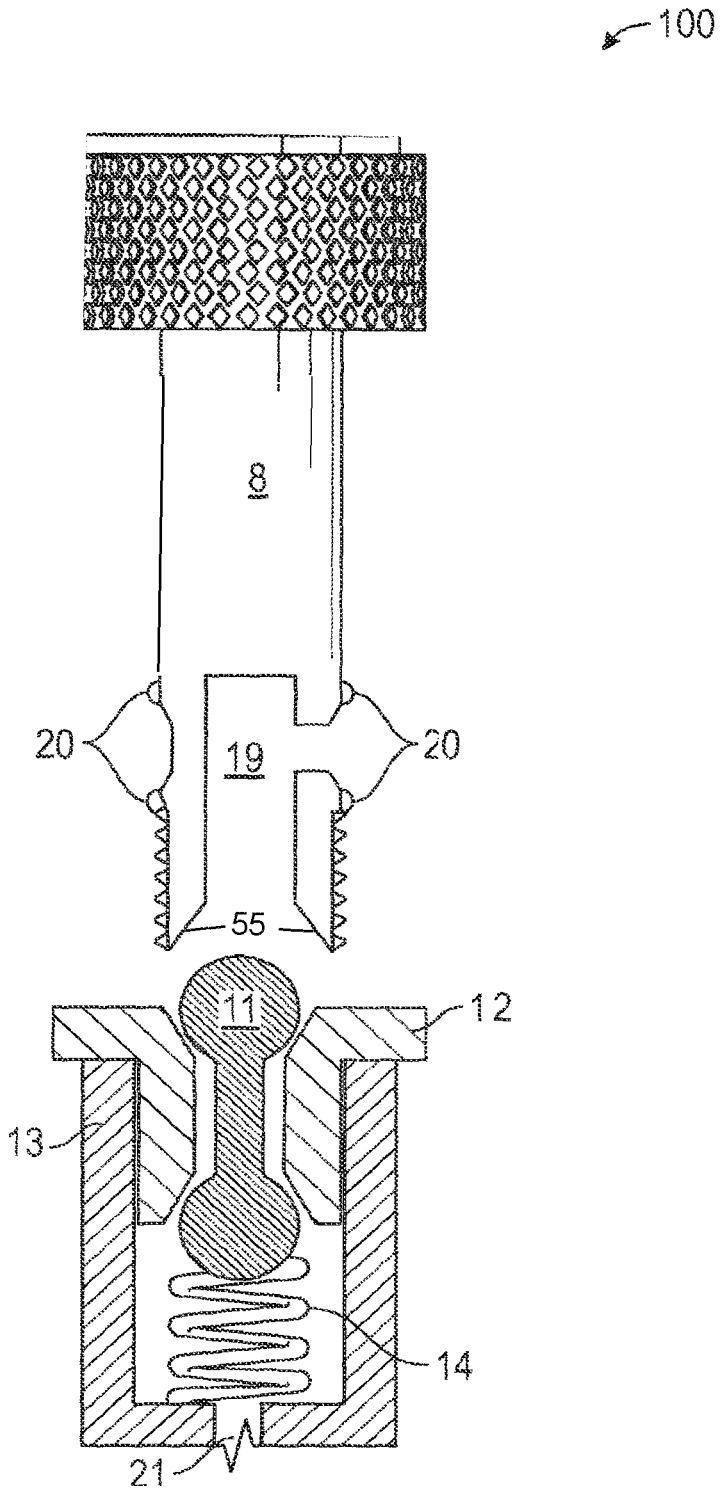
FIG. 3 is a cross-section view drawing which illustrates the internal dual seat valve of FIG. 2 coupled with the dial stem.

In FIG. 3, the dial stem 8 and its features are illustrated to explain the mechanism of venting trapped gas after target temperature is reached. Once vessel fluid temperature is at or above target temperature, the lower valve seat of dual seat valve 12 is moved into contact with peanut valve 11, as described above. This contact then pulls the upper ball from contact with conical valve seat at the bottom of dial stem port 19, revealing a passage to exhaust trapped gas pressure.

Figure 4A:
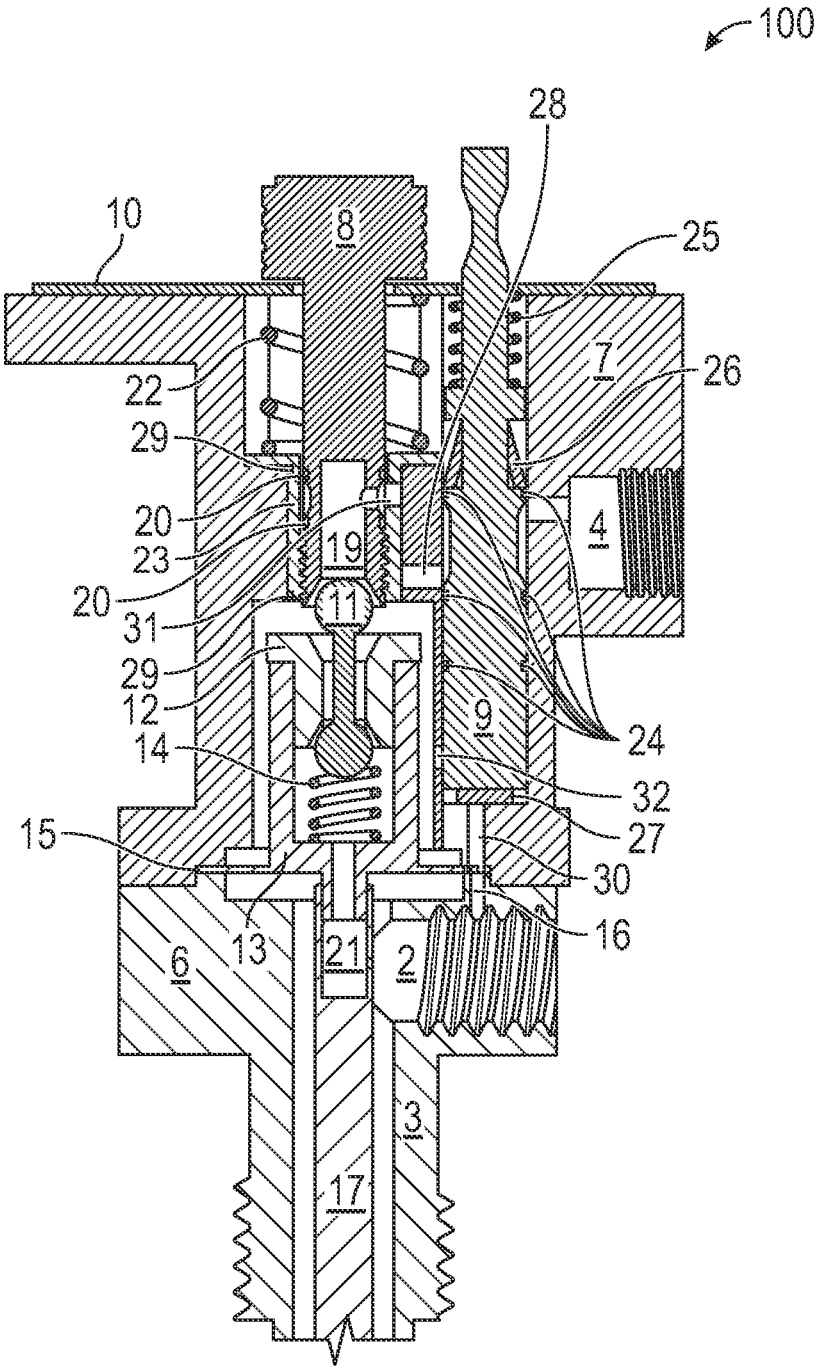
FIGS. 4A and 4B are cross-section view drawings of a pneumatic thermostat of an embodiment of the present invention which respectively illustrate the pneumatic thermostat in an closed and an open state.

The eventual escape of trapped gas pressure is further illustrated in FIG. 4A. The exhaust gas is directed out of sleeve 23 to sleeve exhaust port 31 via dial stem O-rings 20. Exhaust gas then enters the tolerance between sleeve 23 and body 7, isolated via sleeve O-rings 29. Next, exhaust gas travels through first body exhaust port 28 and into the tolerance between bypass plunger 9, isolated via the upper and middle bypass plunger O-rings 24. Finally, the exhaust pressure exits via exhaust port 4.

The release of trapped pressure during low temperature threshold shutdown is also illustrated in FIG. 4A. As described previously, once contact with the upper ball of peanut valve 11 has occurred, valve shuttle rod 17 is now pushing directly against sleeve 23. With continued contraction, sleeve 23 is then pressed back against sleeve spring 22. During this motion, the lower set of sleeve O-rings 29 is moved past first body exhaust port 28, revealing the same exhaust path described in the preceding paragraph from first body exhaust port 28 forward. At this point trapped gas is vented.

Figure 4B:
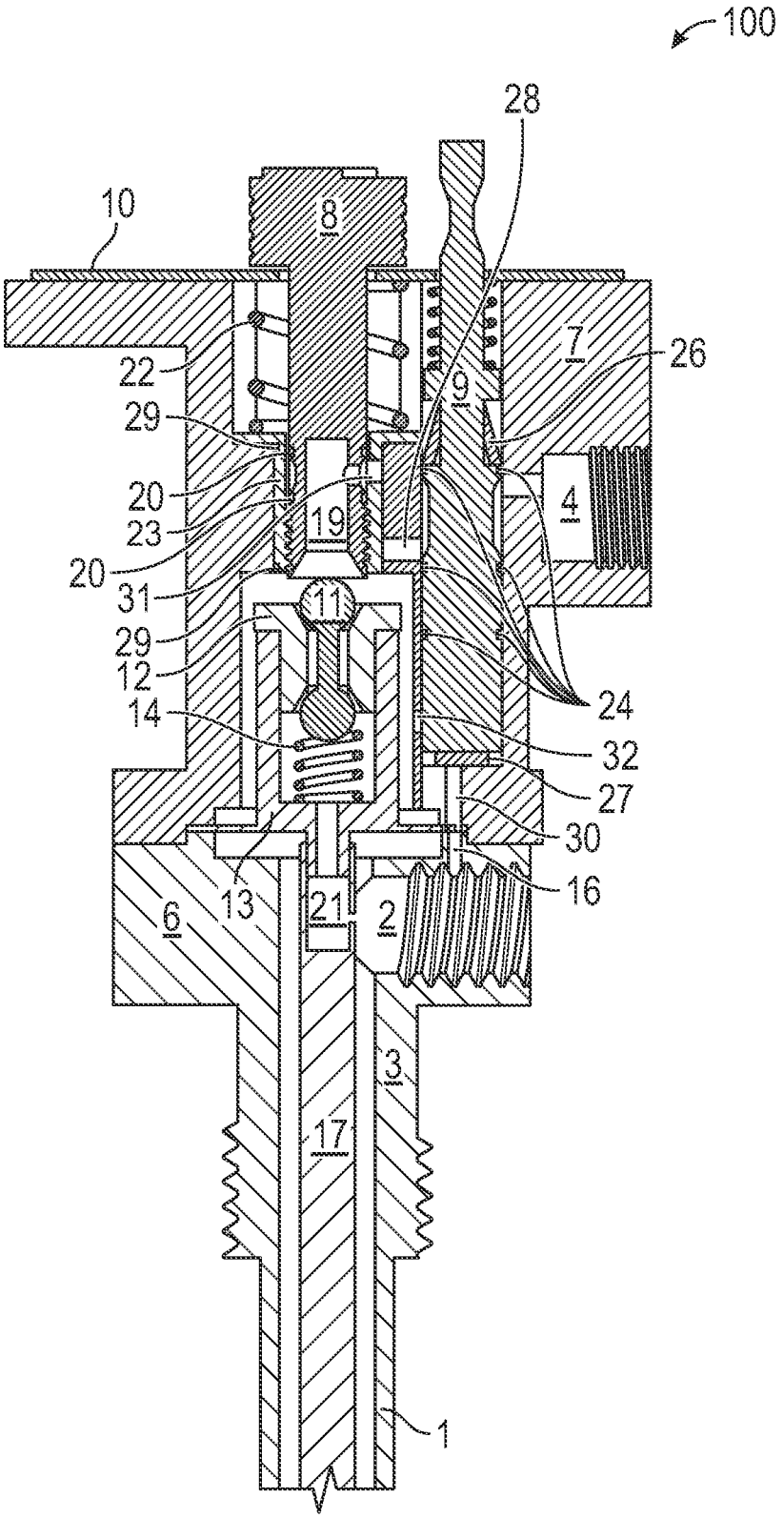

Due to the orientation of FIGS. 4A and B, pressure output port 5 is not visible. It is noted that pressure output port 5 is in direct communication with the cavity between the exterior of dual seat valve 12 and valve shuttle 13, and the interior of body 7. As illustrated in FIGS. 4A and 4B, the thermostatic set point of thermostat 100 is based on the advancement or retraction of dial stem 8 in relation to sleeve 23. In one embodiment, dial stem 8 is preferably threaded such that advancement and/or retraction of dial stem 8 can be accomplished by twisting dial stem 8 to a target temperature that is illustrated on dial face 10. Twisting dial stem 8 will result in advancement or retraction relative to sleeve 23 due to their threaded interface. Adjusting the position of conical valve seat of dial stem port 19 provides adjustability in the temperature at which actuation of peanut valve 11 occur.

The bypass function of the thermostat 100 is also illustrated in FIGS. 4A and 4B. When found in a low temperature threshold fault, thermostat 100 can be bypassed by use of bypass plunger 9. When in low temperature threshold fault, thermostat 100 is in a state in which sleeve 23 is pressed back by contracted expansion sleeve 1. This state creates a space between the lip of sleeve 23 and body 7. When bypass plunger 9 is pulled, bypass plunger clip 26, which is preferably a compressed conical spring clip with a slot for contraction and expansion, expands into the space between sleeve 23 and body 7. Bypass plunger 9 creates a force on bypass plunger spring 25, which presses bypass plunger 9 back toward its resting position as illustrated in FIGS. 4A and 4B. The now expanded bypass plunger clip 26 retains bypass plunger 9 out of its resting position. In this bypass position, bypass plunger gasket 27 is moved up such that it is no longer seated in bypass input port 30, thus allowing gas pressure from bypass port 16 to travel to be discharged through output port 5 via bypass output port 32. In this position, gas pressure is supplied to pressure open valve 36, supplying fuel to main burner 38. This incoming pressure is sealed from exhaust port 4 via the lower O-ring of bypass plunger O-rings 24. Additionally, in this position the middle O-ring of bypass plunger O-rings 24 eliminates the communication of first body exhaust port 28 and exhaust port 4, and thus eliminating it as an exit for incoming pressure. At this point, main burner 38 is lit and vessel fluid temperature is rising, once expansion sleeve 1 has expanded to a point that valve shuttle rod 17 has pulled back enough, sleeve 23 is pressed back into its resting position by sleeve spring 22. Once pressed into this position, sleeve 23 has now compressed bypass plunger clip 26 to a point it unlatches and allows bypass plunger 9 return to its resting position. Consequently, a technician can restart the burner system using this bypass and the system will automatically reset in normal operation once the vessel temperature has returned to within an operating range.

During assembly of the present invention, the interface of body 7 and base 6 is preferably sealed. This seal is most preferably made via gasket 15, which most preferably is formed from an elastomeric material. Gasket 15 not only seals the interface of body 7 and base 6 but also seals the interface of valve shuttle 13 and valve shuttle rod 17. Gasket 15 allows valve shuttle 13 to advance and retract due to its elastic nature.

FIG. 5 illustrates a pneumatic burner control system, in which embodiments of pneumatic thermostat 100 can be utilized. Although FIG. 5 illustrates a conventional pneumatic burner control system having a conventional pneumatic thermostat 34, pneumatic thermostat 100 of an embodiment of the present invention can be used in place of pneumatic thermostat 34. In such a system, control gas is typically plumbed into the input of pneumatic thermostat 34 via pressure input line 33. Depending on the temperature of vessel 35 contained fluids, pneumatic thermostat 34 supplies or removes pressure from pressure open valve 36. When pressure is applied to pressure open valve 36, a substantial amount of fuel can be allowed past from fuel gas supply 37 to main burner 38. This incoming fuel volume is then ignited by the standing pilot 39, located proximal to main burner 38.

Figure 6:
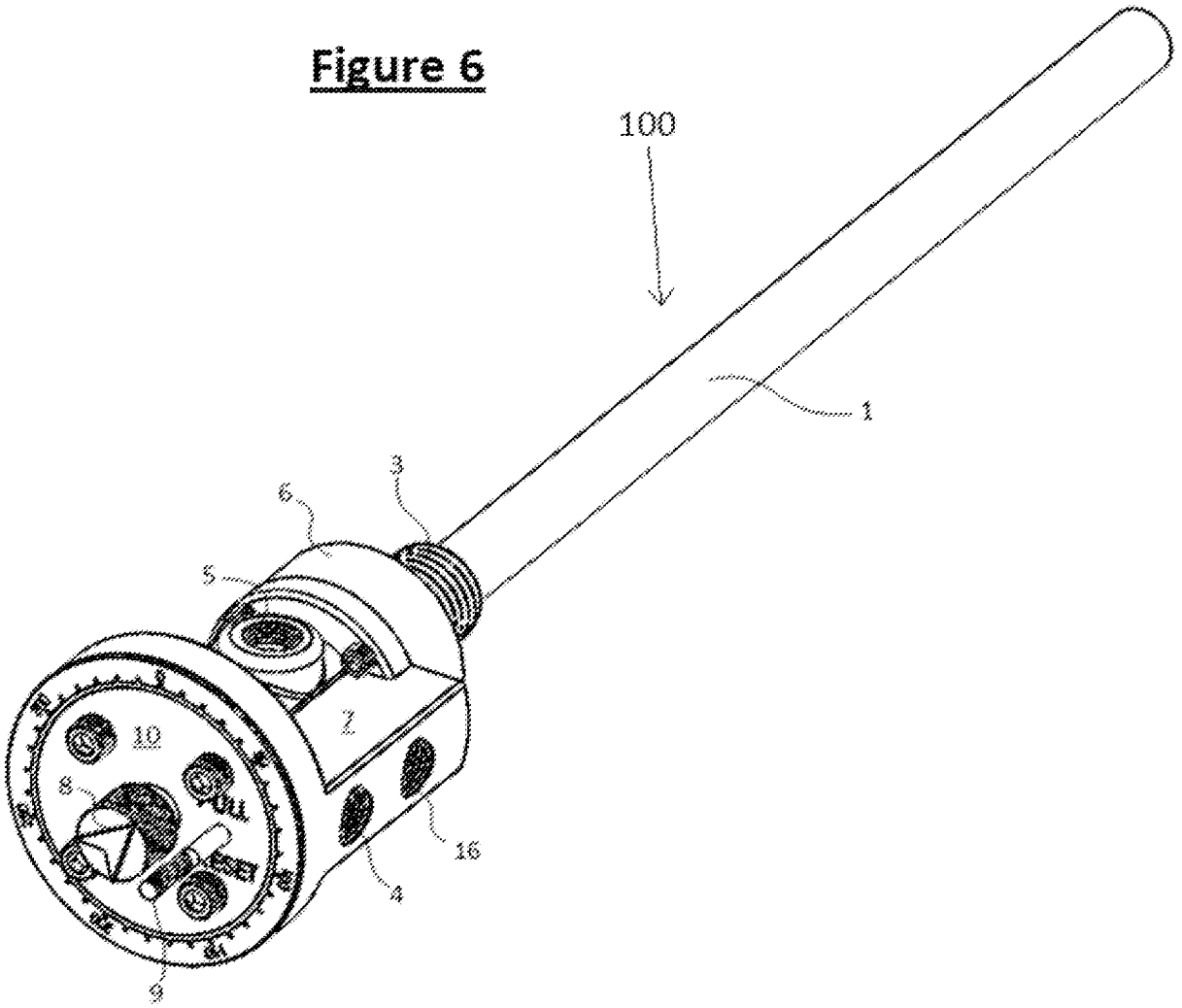
FIG. 6 is a drawing which illustrates a pneumatic thermostat having an external dedicated bypass port according to an embodiment of the present invention.

FIG. 6 illustrates another embodiment of pneumatic thermostat 100 according to the present invention. This embodiment is much the same as the embodiment of FIG. 1 except that bypass port 16 now has an external dedicated port. Additionally, this embodiment also has input port 2 on base 6 but is not seen due to the orientation of FIG. 6.

Figure 7:
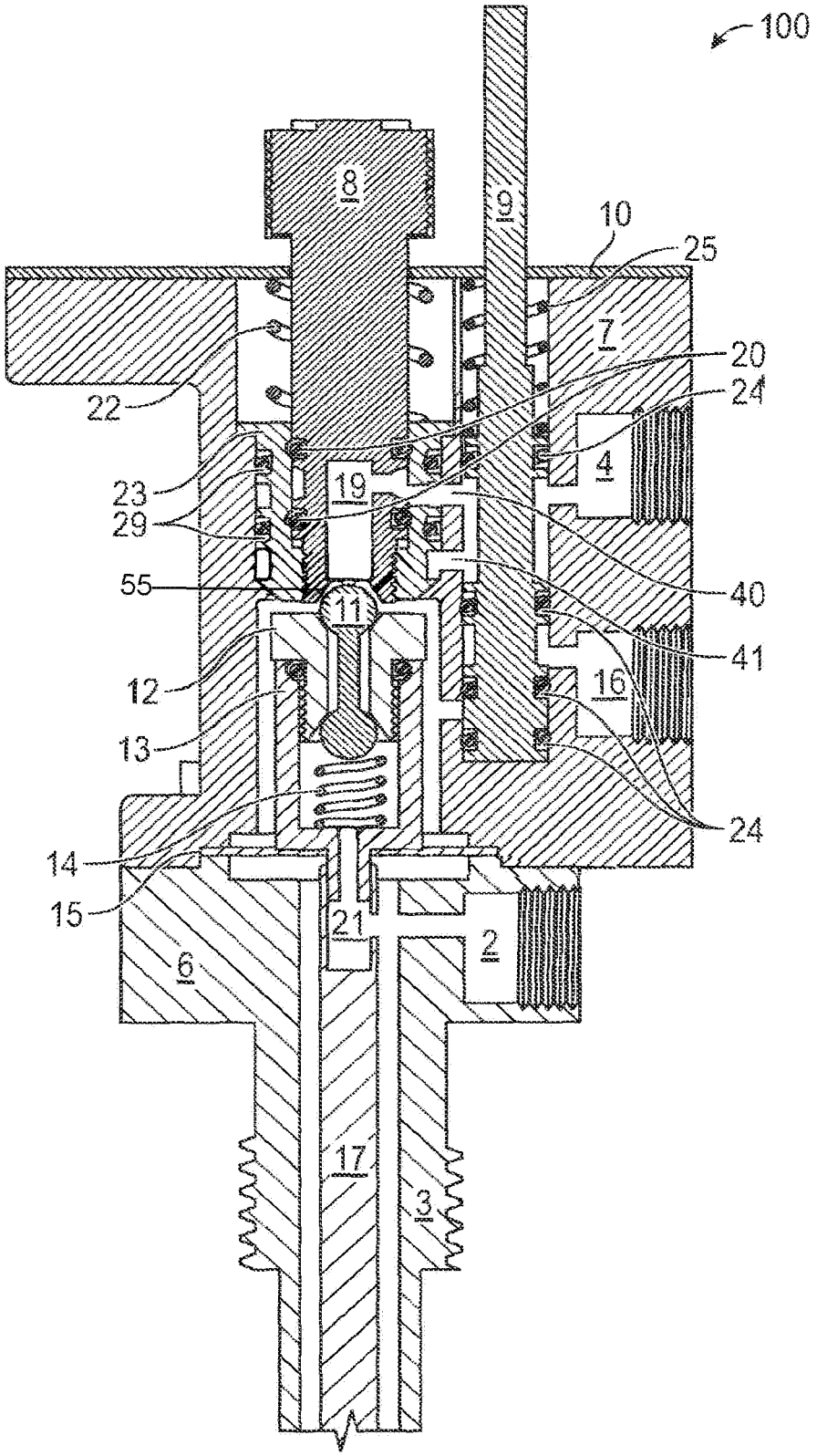
FIGS. 7 and 8 are cross-section view drawings which illustrate a cross-section view of an embodiment of a pneumatic thermostat having an external dedicated bypass portion in both a lowered, normal configuration (FIG. 7) and a raised bypass configuration (FIG. 8)
Figure 8:
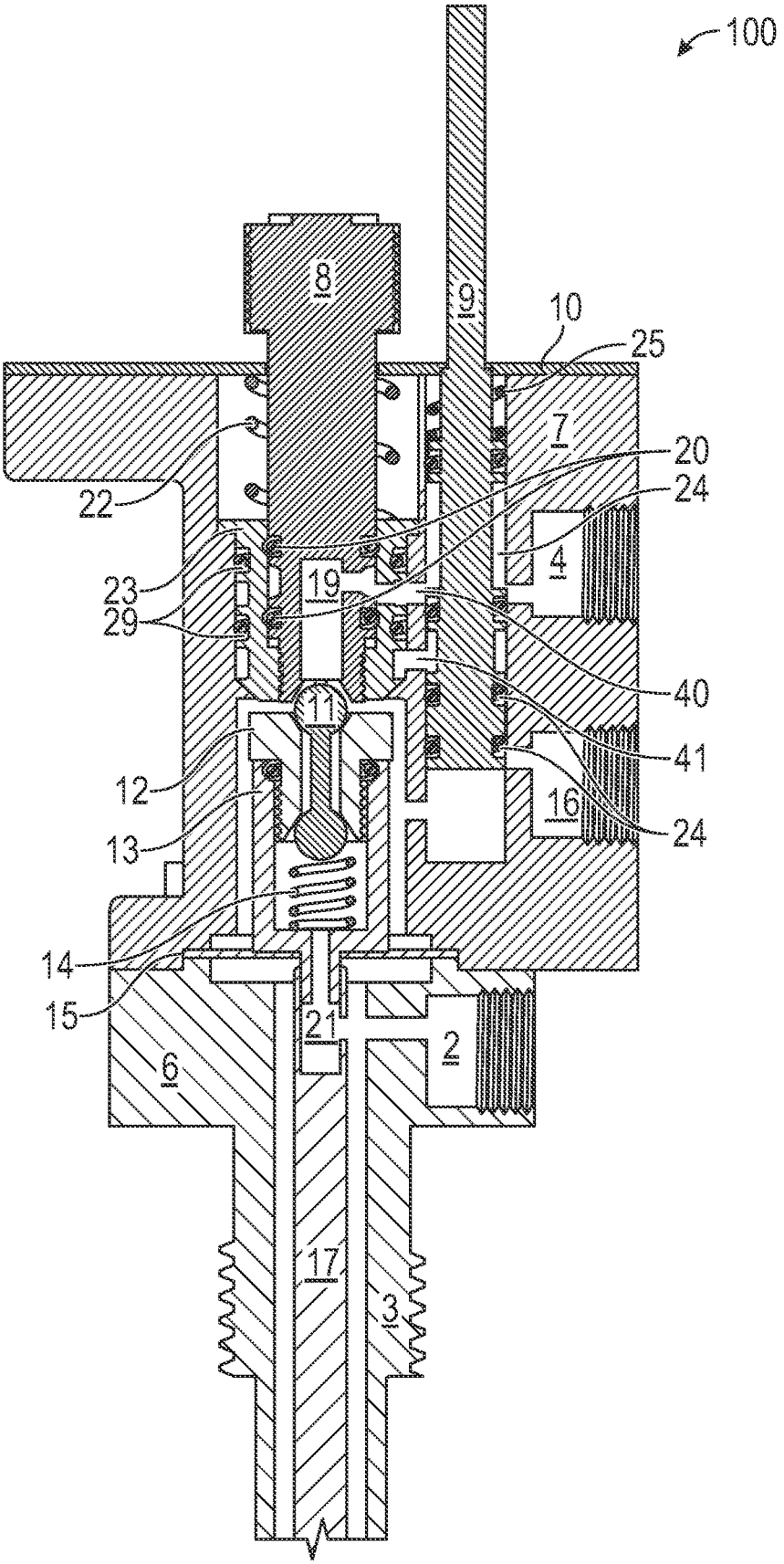

FIGS. 7 and 8 are cross-section view drawings of the embodiment of FIG. 6 which respectively illustrate thermostat 100 with bypass stem 9 in a lowered and raised position. This embodiment is much the same as the first embodiment excluding the low temperature vent on sleeve 23, bypass plunger 9 and corresponding vent locations in body 7. Aforementioned processes described herein are applicable to this embodiment but excludes the lower set of O-rings 29 and now preferably includes a male conical face at the bottom of sleeve 23, seating in a female conical ring inside body 7. The contact between the bottom of sleeve 23 and internal ring of body 7 seals pressure from escaping around bypass stem 9 and out exhaust port 4 until sleeve 23 is moved back by continued contraction, as described herein. Furthermore, the alternative bypass stem 9 can be seen in FIGS. 7 and 8 and is presented in its normal operating position in FIG. 7. The bypass stem 9 utilizes bypass plunger O-rings 24 for the isolation and communication of a series of ports for normal and bypass operations. In the position of FIG. 7, bypass plunger 9 blocks pressure from communication with the cavity between the exterior of dual seat valve 12 and valve shuttle 13, and the interior of body 7. Additionally, in this position, bypass stem 9 allows for passage of vent gas for both target and low temperature shutdowns to exhaust port 4.

FIG. 8 illustrates activation of bypass stem 9. As in the first described embodiment, bypass stem 9, and in reference to the system configuration of FIG. 5, when activated, preferably allows for bypass pressure to reach pressure open valve 36 and preferably resets once target temperature is reached. Once bypass stem 9 is pulled into this position, bypass pressure enters through bypass port 16 and into communication with the cavity between the exterior of dual seat valve 12 and valve shuttle 13, and the interior of body 7, ultimately pressurizing pressure open valve 36 via pressure output port 5. Once pressure has equalized, the pressure beneath the lowest bypass stem O-ring 24 is sufficient to overcome the force now generated by bypass spring 25, holding bypass plunger 9 in place. Additionally, the low temperature vent created by sleeve 23 being held off seat with body 7 is isolated from escape via the two middle bypass O-rings 24. In this position, the main burner 38 has been activated and bypass stem holds in position until vessel 35 temperature reaches target. Once vessel 35 contained fluids reach target temperature, the upper ball of peanut valve 11 is pulled from the conical valve seat on the bottom of dial stem 8 and bypass pressure is vented through the unobstructed path between dial stem port 19 and exhaust port 4. As long as supply pressure is choked coming from bypass port 16 relative to the vent path described, the resulting pressure beneath the lowest set of bypass plunger O-rings 24 will begin to decrease and ultimately allows bypass spring 25 to return bypass stem 9 to its normal position. Once again, this embodiment allows bypass with autonomous return to normal position once the vessel temperature has returned to target temperature.

In FIGS. 7 and 8, it is noted that dial stem O-rings 20 serve the same purpose as in the previous embodiment of the invention, but the purpose of sleeve O-rings 29 has changed. The upper sleeve O-ring 29 still serves the purpose of sealing pressure from escape from the apparatus, as does the upper dial stem O-ring 20 and upper sleeve O-ring 23, but the lower sleeve O-ring 29 now preferably serves the purpose of isolating the target temperature exhaust port 40 from low temperature exhaust port 41. This is especially helpful during bypass operations, as low temperature exhaust port 41 is preferably isolated from exhaust port 4, while target temperature exhaust port 40 remains in communication with exhaust port 4.

Figure 9:
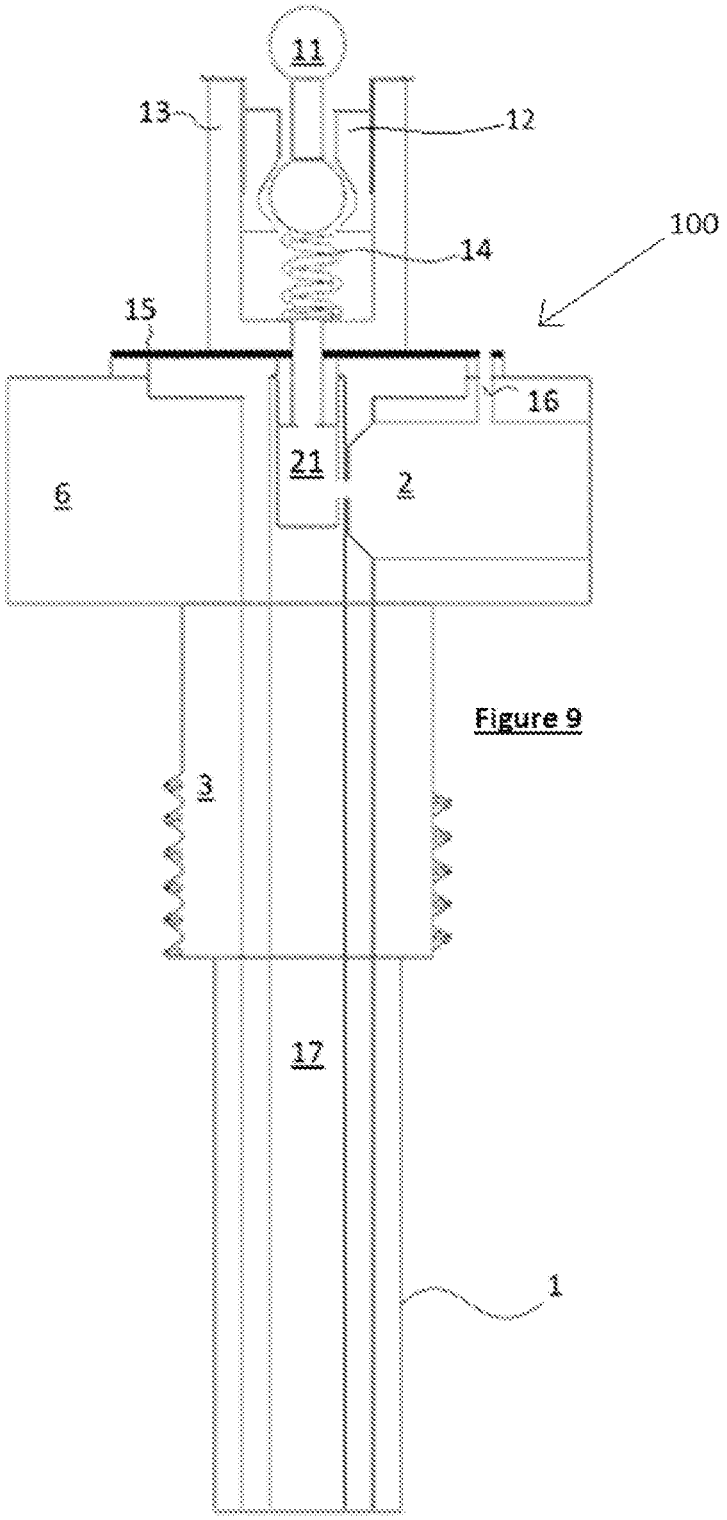
FIG. 9 is a cross-section view drawing which illustrates a valve of the present invention which closes during low temperature shutdown by contacting a lower ball of the peanut valve in the seat below it.

FIG. 9 illustrates an additional embodiment of dual seat valve 12. In this embodiment, the pneumatic operation of dual seat valve 12 is preferably the same as the first embodiment in terms of shutting at low and target temperatures with the same mechanics described. The difference between this embodiment and the previously described embodiment, is the shutting of this valve during low temperature shutdown due to contact of the lower ball with the valve seat beneath it.

It is noted that in FIGS. 7 and 8 almost zero clearance is seen between the balls of peanut valve 11 and dual seat valve 12. This is demonstrative of the small amount of travel incurred by the assembly, and it is noted that some amount of clearance between peanut valve 11 and dual seat valve 12 is preferably provided.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference. Unless specifically stated as being "essential" above, none of the various components or the interrelationship thereof are essential to the operation of the invention. Rather, desirable results can be achieved by substituting various components and/or reconfiguration of their relationships with one another. Note that in the specification and claims, "about", "approximately", and/or "substantially" means within twenty percent (20%) of the amount, value, or condition given.

What is claimed is:

1. A pneumatic thermostat comprising:

a valve assembly comprising:

a dual seat valve, a first valve seat disposed or formed onto on a first end of said dual seat valve, a second valve seat disposed or formed onto a second end of said dual seat valve, a passageway connecting said first valve seat and said second valve seat, and a connecting member disposed within said passageway, said connecting member rigidly connecting a first plug to a second plug and configured to translate within said passageway; and a dial stem communicably coupled to a third valve seat, said first plug configured to seat against said third valve seat, and said first plug is configured to seat against said first valve seat and said second plug configured to seat against said second valve seat.

2. The pneumatic thermostat of claim 1 further comprising a bypass stem configured to allow a flow of fluid through said thermostat to an end device during a bypass operation.

3. The pneumatic thermostat of claim 1 further comprising a bypass stem configured to autonomously reset when a bypass pressure is reduced.

4. The pneumatic thermostat of claim 1 further comprising a bypass supply port.

5. The pneumatic thermostat of claim 4 wherein said bypass supply port comprises an internal cross-sectional area which is smaller than a sum total of all cross-sectional areas of exhaust paths when a bypass stem is in a reset configuration.

6. The pneumatic thermostat of claim 1 further comprising a thermal expansion sleeve mated to an internal rod and said internal rod communicably coupled to said dual seat valve.

7. The pneumatic thermostat of claim 1 further comprising a sleeve coupled to a dial stem and wherein said third valve seat is disposed or otherwise formed onto a terminal end of said dial stem.

8. The pneumatic thermostat of claim 1 further comprising a body encompassing said valve assembly and at least a portion of a bypass stem, said body comprising a plurality of ports.

9. The pneumatic thermostat of claim 1 wherein said first plug and said second plug are at least substantially equal in size.

10. The pneumatic thermostat of claim 1 wherein said first valve seat and said second valve seat comprise a conical shape.

11. The pneumatic thermostat of claim 1 wherein said connecting member comprises a rod.

12. The pneumatic thermostat of claim 1 wherein said first plug and said second plug each comprise a curved shape.

13. The pneumatic thermostat of claim 1 wherein said curved shape comprises a spherical shape, except for a connection location of said connecting member.

14. The pneumatic thermostat of claim 1 wherein said pneumatic thermostat is configured to provide a valve open condition when subjected to an operating temperature.

15. The pneumatic thermostat of claim 14 further configured to provide a valve closed configuration when subjected to a temperature that is greater than the operating temperature.

16. The pneumatic thermostat of claim 15 further configured to provide a valve closed configuration when subjected to a temperature that is less than the operating temperature.

17. A method for controlling a flow of hydrocarbon gas to a burner, the method comprising: adjusting a dial stem communicably coupled to a third valve seat, wherein a first plug is configured to seat against the third valve seat, and shuttling a pneumatic thermostat valve between three states via a force generated from thermal expansion and/or contraction of a member, wherein the three states comprise: a first state, the first state being a closed-valve state experienced when the member is in an expanded member condition, a third state, the third state being a closed-valve state experienced when the member is in a retracted member condition, a second state, the second state being an open-valve state experienced when the member is in a condition between the expanded member condition and the retracted member condition and wherein hydrocarbon gas is allowed to flow from the pneumatic thermostat valve during the open-valve state.

* * * * *